US009412480B2

(12) United States Patent
Lopez et al.

(10) Patent No.: US 9,412,480 B2
(45) Date of Patent: Aug. 9, 2016

(54) DIFFRACTION LEVERAGED MODULATION OF X-RAY PULSES USING MEMS-BASED X-RAY OPTICS

(71) Applicant: UChicago Argonne, LLC, Chicago, IL (US)

(72) Inventors: Daniel Lopez, Chicago, IL (US); Gopal Shenoy, Naperville, IL (US); Jin Wang, Burr Ridge, IL (US); Donald A. Walko, Woodrige, IL (US); Il-Woong Jung, Woodridge, IL (US); Deepkishore Mukhopadhyay, Ventura, CA (US)

(73) Assignee: uchicago Argonne, LLC, Chicago, IL (US)

( * ) Notice: Subject to any disclaimer, the term of this patent is extended or adjusted under 35 U.S.C. 154(b) by 181 days.

(21) Appl. No.: 13/890,686

(22) Filed: May 9, 2013

(65) Prior Publication Data

US 2014/0334607 A1 Nov. 13, 2014

(51) Int. Cl.
*G21K 1/06* (2006.01)

(52) U.S. Cl.
CPC ..... *G21K 1/06* (2013.01); *G21K 2201/062* (2013.01)

(58) Field of Classification Search
None
See application file for complete search history.

(56) References Cited

U.S. PATENT DOCUMENTS 6,628,851 B1 9/2003 Rumpf et al.
7,248,358 B2 7/2007 Gerhwind et al.
7,653,173 B2 1/2010 Boyden et al.
2009/0068596 A1 3/2009 Yang et al.
2011/0192248 A1 8/2011 Lopez et al.

OTHER PUBLICATIONS

D. Mukhopadhyay et al., "Temporal Modulation of X-rays Using MEMS Micromirrors," Transducers' 11, Beijing, China, Jun. 5-9, 2011.*

"A MEMS-based high frequency x-ray chopper", by A Siria, O. Dhez, W.Schwartz, G. Torricelli, F. Comin and J Chevrier, Nanotechnology 20 (2009) 175501-175504.

"Capacitive MEMS Microphones" by D. López, et al. Bell Labs Technical Journal (2005) 10 (3), 187-198.

"MEMS-Based Channelized Dispersion Compensator With Flat Passbands", by D. Neilson et al., J. Lightwave Technology, (2004) 22, 101.

"A synchronized rotating crystal x-ray beam chopper" by McPherson, A., Lee, W.-K. & Mills, D. M. (2002). Rev. Sci. Instrum. 73, 2852-2855.

"Feasibility study into the use of mechanical choppers to alter the natural time structure of the APS", by Mills, D. M. (1989). Rev. Sci. Instrum. 60, 2338-2341.

"Extraction of single bunches of synchrotron radiation from storage rings with an X-ray chopper based on a rotating mirror", by Kosciesza, D. & Bartunik, H. D. (1999). J. Synchrotron Rad. 6, 947-952.

(Continued)

*Primary Examiner* — Thomas R Artman
(74) *Attorney, Agent, or Firm* — Joan Pennington

(57) ABSTRACT

A method and apparatus are provided for implementing Bragg-diffraction leveraged modulation of X-ray pulses using MicroElectroMechanical systems (MEMS) based diffractive optics. An oscillating crystalline MEMS device generates a controllable time-window for diffraction of the incident X-ray radiation. The Bragg-diffraction leveraged modulation of X-ray pulses includes isolating a particular pulse, spatially separating individual pulses, and spreading a single pulse from an X-ray pulse-train.

16 Claims, 10 Drawing Sheets

(56) References Cited

OTHER PUBLICATIONS

"On the design of ultrafast shutter for time-resolved synchrotron experiments" by Milan Gembicky and Philip Coppens, J. Synchrotron Rad. (2007). 14, 133-137.
"An Ultrafast Mechanical Shutter of X-Rays" by LeGrand, A. D., Schildkamp, W. & Blank, B. (1989). Nucl. Instrum. Methods Phys. Res. A, 275, 442-446.
U.S. Appl. No. 13/022,353, filed Feb. 7, 2011 by Daniel A. Lopez et al., entitled "Microelectomechanical (MEMS) Manipulators for Control of Nanoparticle Coupling Interactions".
E. Vlieg et al., "Surface X-Ray Scattering during Crystal Growth: Ge on Ge(111)", Physical Review Letters vol. 61, pp. 2241-2244 (1998).
B. M. Ocko et al., "In Situ Reflectivity and Diffraction Studies of the Au(001) Reconstruction in an Electrochemical Cell", Physical Review Letters vol. 65, pp. 1466-1469 (1990).

* cited by examiner

MEMS BASED DIFFRACTIVE OPTICS DEVICE

200

220

300

320

330

340

400

DIFFRACTION LEVERAGED MODULATION OF X-RAY PULSES USING MEMS-BASED X-RAY OPTICS

CONTRACTUAL ORIGIN OF THE INVENTION

The United States Government has rights in this invention pursuant to Contract No. DE-AC02-06CH11357 between the United States Government and UChicago Argonne, LLC representing Argonne National Laboratory.

FIELD OF THE INVENTION

The present invention relates generally to the temporal modulation of X-rays, and more particularly, relates to a method and apparatus for implementing Bragg-diffraction leveraged modulation of X-ray pulses using MicroElectro-Mechanical systems (MEMS) based diffractive optics.

DESCRIPTION OF THE RELATED ART

U.S. patent application Ser. No. 13/246,008 filed Sep. 27, 2011, entitled "METHOD FOR SPATIALLY MODULATING X-RAY PULSES USING MEMS-BASED X-RAY OPTICS" by Daniel Lopez et al., the present inventors, and assigned to the present assignee, discloses a method and apparatus for spatially modulating X-rays or X-ray pulses using MicroElectroMechanical or microelectromechanical systems (MEMS) based X-ray optics including oscillating MEMS micromirrors. A torsionally-oscillating MEMS micromirror and a method of leveraging the grazing-angle reflection property are provided to modulate X-ray pulses with a high-degree of controllability.

Modern materials of technological importance are replete with cyclical and nonequilibrium processes that span multiple time-scales ranging from milliseconds to femtoseconds. They include, for example, next-generation denser and faster information storage devices, catalysts responsible for energy conversion, or optogenetic devices used for neurobiological control. A fundamental understanding of the ultrafast dynamics of charge-, spin- and atomic-organization in these materials is essential to understand the processes and to control them to attain the desired functions. The availability of synchrotron radiation X-ray sources during the past decade, especially the development of X-ray free-electron-lasers (XFELs), has allowed the probing of these processes with femtosecond to picosecond resolution following the excitation by an energy stimulus (pump) from an optical laser or a magnetic/electric pulse generator or a THz source.

Recently, there has been an overwhelming interest in exploring time-domain science using X-ray pulses generated by synchrotron radiation sources. The unique properties of X-ray pulses (duration, pulse train, and the like) from these sources can be enhanced using ultrafast MEMS-based X-ray optics. A need exists to develop such ultrafast MEMS-based X-ray diffractive optics.

A need exists for a method and apparatus for implementing Bragg-diffraction leveraged modulation of X-ray pulses using MicroElectroMechanical systems (MEMS) based X-ray diffractive optics. It is desirable to provide such MEMS based diffractive optics to control the delivery of hard X-ray pulses from a synchrotron radiation source. It is desirable to provide such method and apparatus for implementing Bragg-diffraction leveraged modulation of X-ray pulses that achieves a narrow width of the diffractive time-widow from high angular velocity of the MEMS based X-ray diffractive optics.

SUMMARY OF THE INVENTION

Principal aspects of the present invention are to provide a method and apparatus for implementing Bragg-diffraction leveraged modulation of X-ray pulses using MicroElectro-Mechanical systems (MEMS) based diffractive optics. Other important aspects of the present invention are to provide such method and apparatus substantially without negative effect and that overcome some of the disadvantages of prior art arrangements.

In brief, a method and apparatus are provided for implementing Bragg-diffraction leveraged modulation of X-ray pulses using MicroElectroMechanical systems (MEMS) based diffractive optics. An oscillating crystalline MEMS device generates a controllable time-window for diffraction of the incident X-ray radiation. A narrow width of the diffractive time-widow is achieved by a selected angular velocity of the MEMS device.

In accordance with features of the invention, the oscillating crystalline MEMS device includes a single-crystal MEMS that can diffract or transmit X-ray radiation by changing its relative orientation to the incident X-ray beam. The oscillating MEMS device diffracts the X-ray pulses over a short period of time when the Bragg condition is satisfied.

In accordance with features of the invention, the oscillating crystalline MEMS device with a high angular velocity, for example, of 1.262°/μs (microsecond) sorts consecutive X-ray pulses with a separation as close as 2.8±0.4 ns (nanosecond). The MEMS angular speed determines the width of the diffractive time window over which the Bragg condition is fulfilled.

In accordance with features of the invention, the MEMS based X-ray diffractive optics includes a single-crystal-silicon (SCS) device layer formed on a Silicon-On-Insulator (SOI) wafer, using conventional semiconductor fabrication technique. The substrate beneath the crystal is removed to allow large out-of-plane oscillations and to allow transmission of X-rays.

In accordance with features of the invention, the MEMS based X-ray diffractive optics includes in-plane comb-drive actuators, formed by, for example, inter-digitated capacitors (IDCs).

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, a method and apparatus are provided for implementing Bragg-diffraction leveraged modulation of X-ray pulses using MicroElectro-Mechanical (MEMS) based X-ray diffractive optics. The novel MEMS X-ray diffractive apparatus of the invention provides a crucial capability in investigating dynamical processes in biological, chemical and energy materials, and provides a new method to manipulate pulse shape at the present and future X-ray sources, such as X-ray free-electron-lasers (XFELs).

Figure 1A:
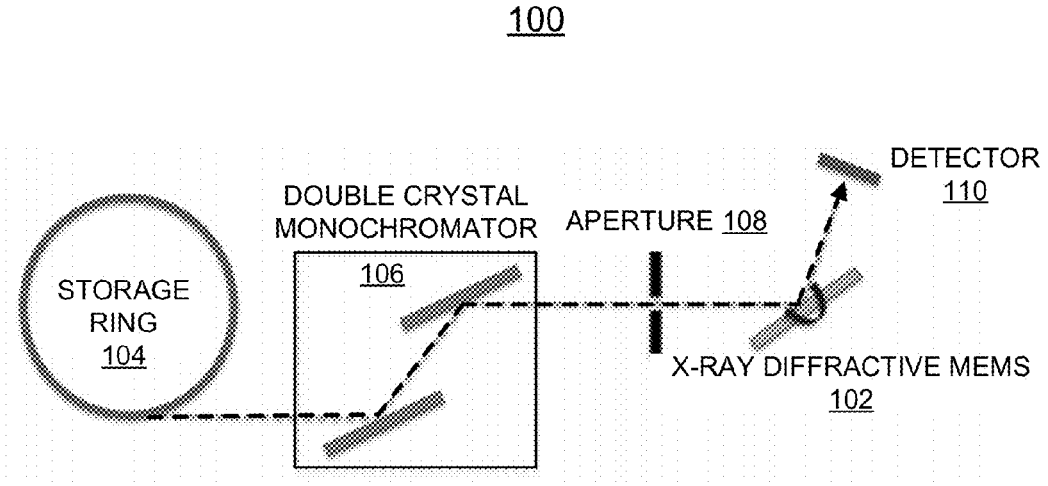
FIGS. 1A and 1B schematically illustrate respectively example MEMS X-ray optics apparatus for implementing Bragg-diffraction leveraged modulation of X-ray pulses and example Bragg diffraction leveraged modulation operation in accordance with preferred embodiments.

Having reference now to the drawings, in FIG. 1A, there is schematically shown example MEMS X-ray diffractive apparatus for implementing Bragg-diffraction leveraged modulation of X-ray pulses generally designated by the reference character 100 in accordance with preferred embodiments. MEMS X-ray diffractive apparatus 100 includes a MicroElectroMechanical (MEMS) based X-ray diffractive optics 102 used in the X-ray wavelength range as diffractive optics.

MEMS X-ray diffractive apparatus 100 includes an X-ray source providing an X-ray radiation such as an X-ray beam, for example, a synchrotron storage-ring 104, such as the Advanced Photon Source (APS) at Argonne National Laboratory. The X-ray beam is monochromatized by a double-crystal monochromator 106, spatially filtered by an aperture 108, diffracted by the MEMS 102 and collected by a detector 110.

Figure 1B:
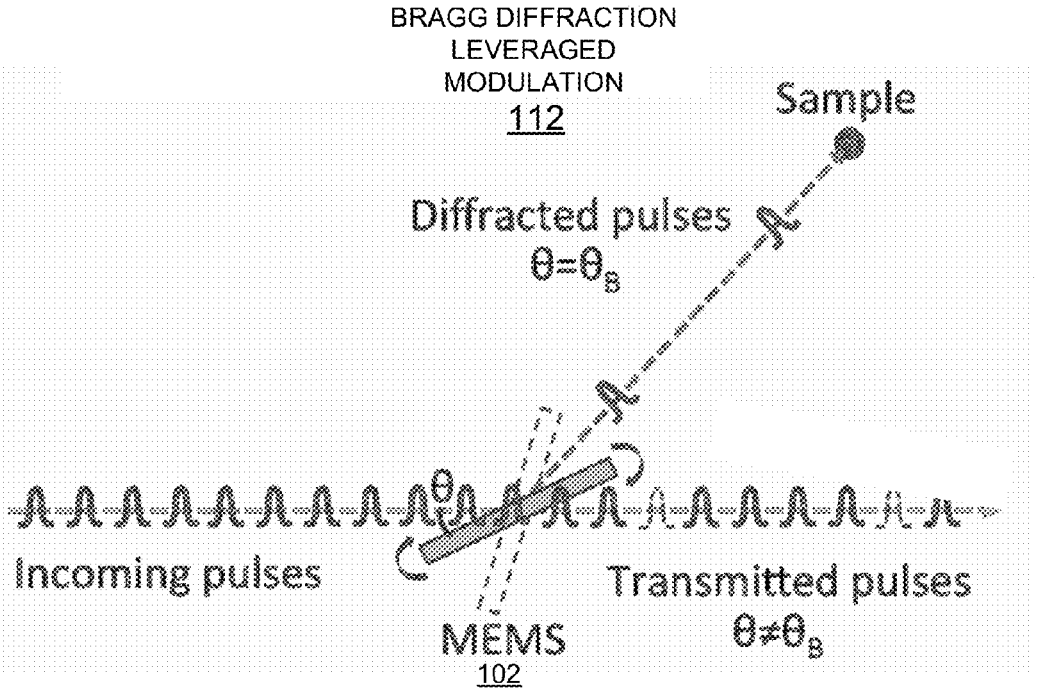

Referring also to FIG. 1B, Bragg diffraction leveraged modulation operation generally designated by the reference character 112 is illustrated in accordance with preferred embodiments. Diffraction of x-ray pulses is realized by placing the MEMS Si-single-crystal in the Bragg condition depending on the energy of the X-rays and the diffraction plane. Incoming pulses applied to the MEMS based X-ray diffractive optics 102 are diffracted when the Bragg condition is satisfied during the dynamic rotation of the crystal, represented by diffracted pulses when $\theta=\theta_B$. When the Bragg condition is not satisfied during the dynamic rotation of the crystal, the X-ray pulses are either absorbed or transmitted.

In accordance with features of the invention, the MEMS angular speed determines the width of the diffractive time window over which the Bragg condition is fulfilled.

FIGS. 1C, and 1D and FIGS. 1E, and 1F respectively illustrate angular velocity of the MEMS and a varied diffractive timing window for higher and lower angular velocity in accordance with preferred embodiments.

Figure 1D:
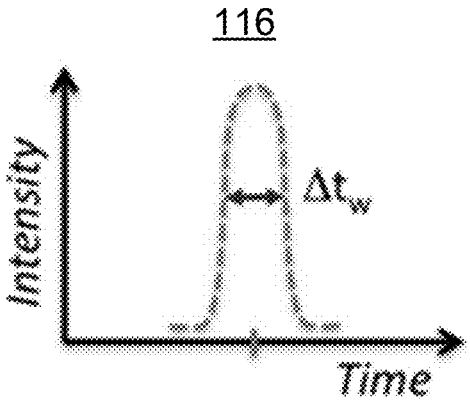
FIGS. 1C, and 1D and FIGS. 1E, and 1F respectively illustrate angular velocity of the MEMS together with a varied diffractive timing window for higher and lower angular velocity in accordance with preferred embodiments.
Figure 1C:
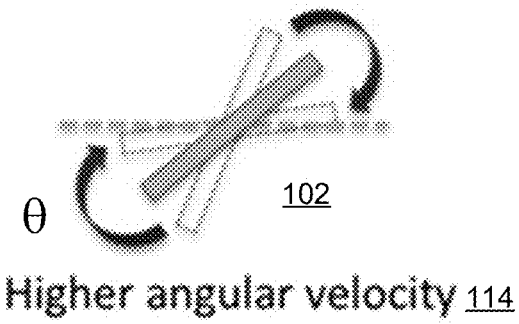

Referring to FIGS. 1C, and 1D, a higher angular velocity 114 is illustrated in FIG. 1C and diffraction of x-ray pulses is realized by placing the MEMS Si-single-crystal 102 in the Bragg condition. In FIG. 1D, an example diffractive time window generally designated by the reference character 116 is illustrated for the higher angular velocity 114 of the MEMS device 102.

Figure 1F:
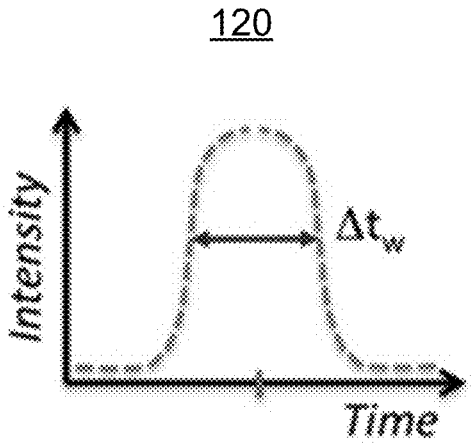
Figure 1E:
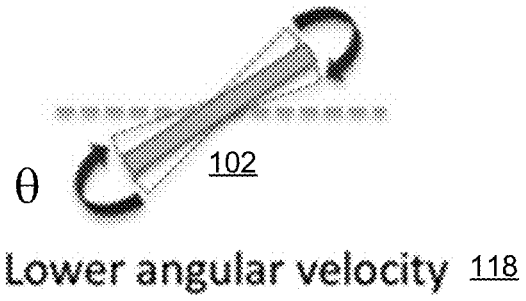

Referring to FIGS. 1E, and 1F, a lower angular velocity 118 is illustrated in FIG. 1E and diffraction of x-ray pulses is realized by placing the MEMS Si-single-crystal 102 in the Bragg condition. In FIG. 1F, an example diffractive time window generally designated by the reference character 120 is illustrated for the lower angular velocity 118 of the MEMS device 102. An illustrated width, $\Delta t_w$, of the illustrated diffractive time window 120 is increased or stretched as compared to the illustrated width, $\Delta t_w$, of the illustrated diffractive time window 116 resulting from the lower angular velocity.

Figure 2A:
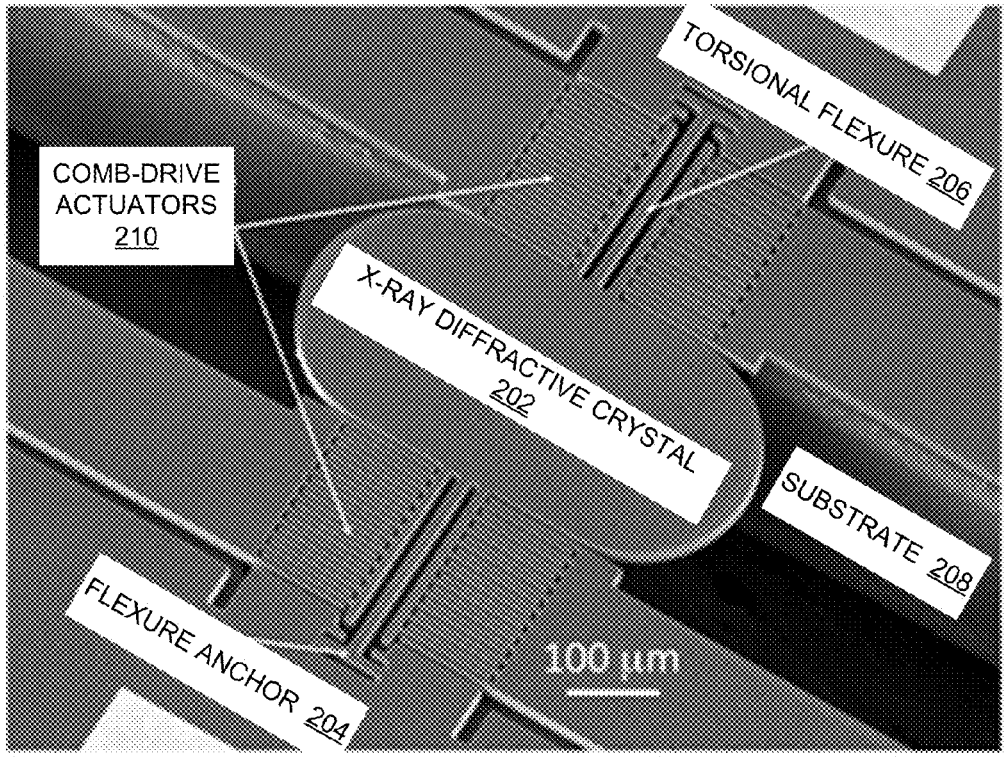
FIGS. 2A and 2B schematically illustrate respectively example MEMS diffractive optics apparatus for implementing Bragg-diffraction leveraged modulation of X-ray pulses and an example static rocking curve with Bragg diffracted pulses $\theta-\theta_B$ (°) shown relative the horizontal axis and reflectivity shown relative the vertical axis showing a prominent Si(400) diffraction peak at 8 keV with nearly 50% reflectivity and broad peaks on the right which originate from lattice strain in accordance with a preferred embodiment.
Figure 2B:
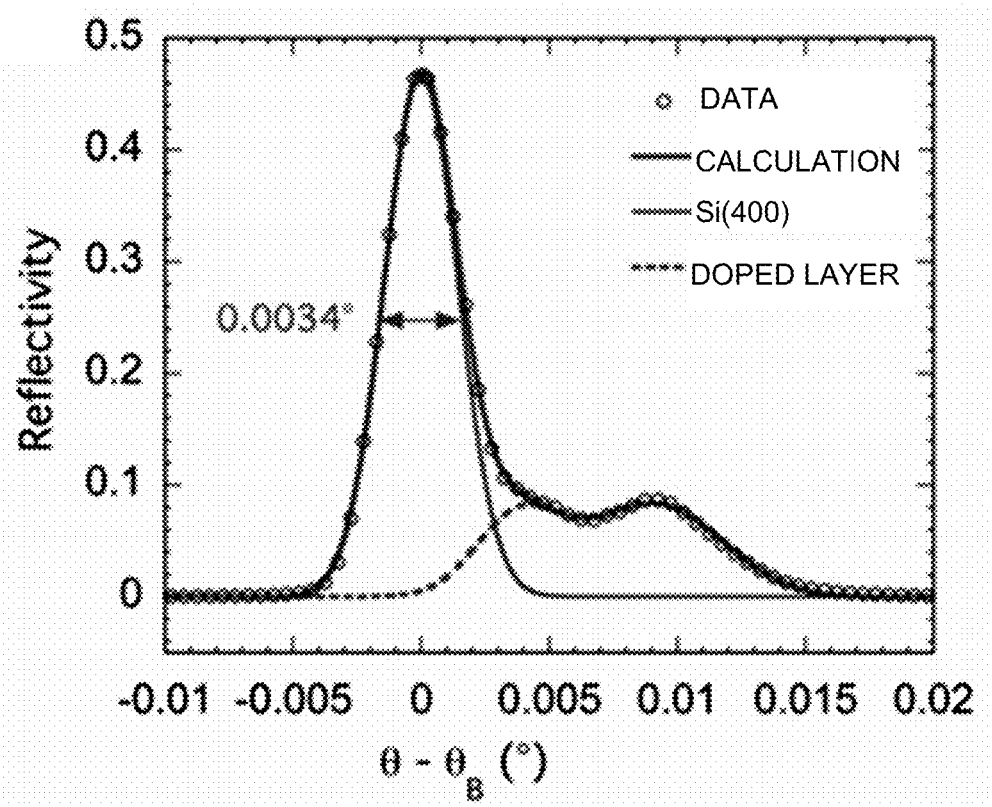

FIGS. 2A and 2B schematically illustrate respective example MEMS diffractive optics apparatus for implementing Bragg-diffraction leveraged modulation of X-ray pulses and an example static rocking curve shows a prominent Si(400) diffraction peak at 8 keV with nearly 50% reflectivity and broad peaks on the right which originate from the lattice strain in accordance with a preferred embodiment.

Referring to FIG. 2A, an electron microscopy image is provided of an example MEMS based diffractive optics device generally designated by the reference character 200 used for implementing Bragg-diffraction leveraged modulation in accordance with preferred embodiments. MEMS based diffractive optics device 200 includes a single X-ray diffractive crystal 202, such as a Si(100) crystal with dimensions of 500 μm (long)×250 μm (wide)×25 μm (thick) suspended by a pair of torsional flexures 204, 206, which are anchored to a substrate 208. The flexures 204, 206 allow the crystal 202 to rotate in the torsional oscillation mode about an axis joining the anchors. The MEMS device 202 is fabricated using a SOI (silicon-on-insulator) wafer, which provides the single-crystal-silicon 202 necessary to diffract x-rays. The substrate 208 beneath the crystal is removed to allow large out-of-plane oscillations and to allow transmission of X-rays. The excitation is provided by in-plane comb-drive actuators 210, which are implemented, for example, by inter-digitated capacitors (IDCs) that provide torque with large force density.

Referring to FIG. 2B, a typical rocking curve of the crystal is shown generally designated by the reference character 220 with a peak reflectivity close to 50%. It consists of a narrow and intense Si(400) peak and additional intensity in the broad peaks above $\theta_B$. The static rocking curve shows a prominent Si(400) diffraction peak at 8 keV with nearly 50% reflectivity and broad peaks on the right which originate from the lattice strain.

In FIG. 2B, these illustrated broad peaks originate from the lattice strain due to shallow diffusive phosphorous dopant layers introduced on the crystal surface during the MEMS fabrication. Since the X-ray diffractive properties of these dopant layers are not known, the intensity was fitted with two Gaussian peaks centered at 0.0038° and 0.0091° above the Si(400) peak. The large angular separation of these two shoulder peaks from the Si(400) peak and their lower intensities allowed an accurate analysis of the Si(400) peak. The line representing Si(400) peak shown in FIG. 2B, also modeled as a Gaussian, has a full-width-at-half-maximum (FWHM), $\Delta\theta_{(400)}$ of 0.0034° (59 microradians). An analysis of the diffraction profile yields an extremely good fit to the measured data as shown in FIG. 2B. Parenthetically, it should be understood that dopant-induced strain can be eliminated in the future by appropriately modifying the MEMS fabrication process.

FIGS. 3A, 3B, 3C, and 3D illustrate respective example dynamic performance of the MEMS diffractive optics in accordance with preferred embodiments.

Figure 3A:
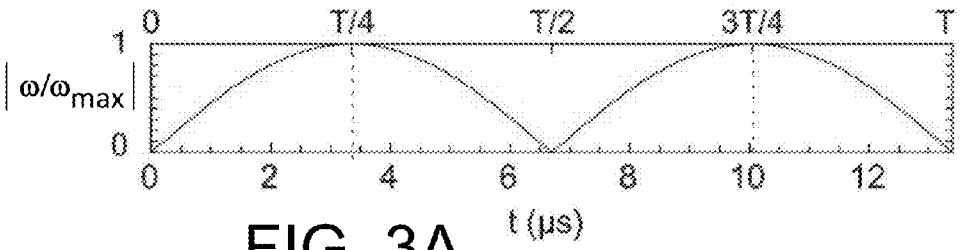
FIGS. 3A, 3B, 3C, and 3D illustrate respective example dynamic performance of the MEMS diffractive optics in accordance with preferred embodiments.

In FIG. 3A, normalized angular velocity generally designated by the reference character 300 over one oscillating cycle of MEMS, where $\omega_{max}$=1.262°/μs.

Figure 3B:
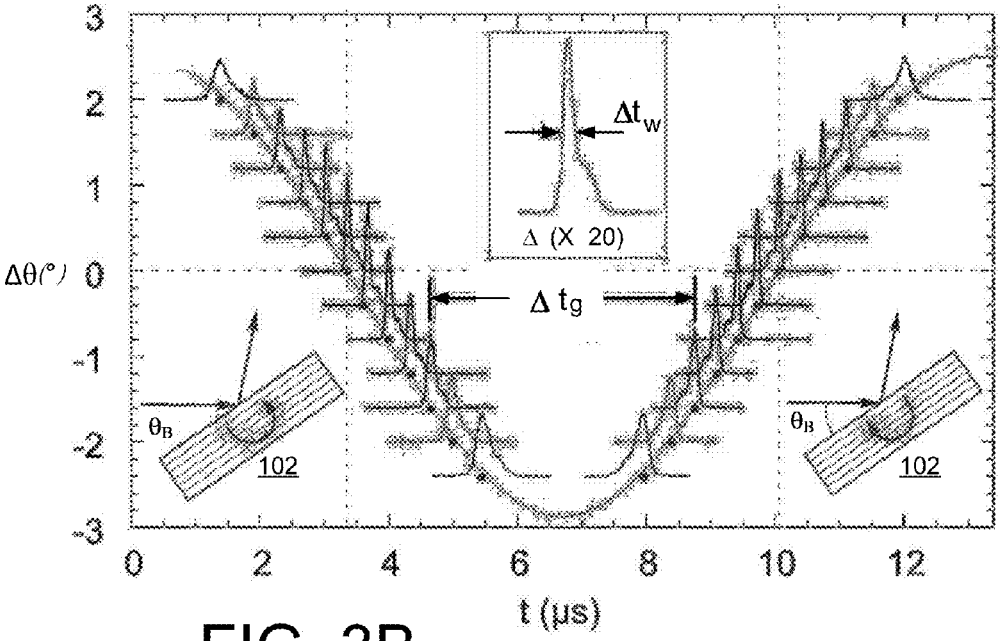

In FIG. 3B, experimental data generally designated by the reference character 320 is shown in the time domain where the position and intensity of the 8 keV diffracted X-ray peaks (locally expanded along the time axis by a factor of 20) over the oscillation cycle is plotted as a function of time over the oscillation period and the values of Δθ. The diffracted peak is narrowest when Δθ=0. The mirror image of diffraction profiles on the two branches of motion highlights the symmetric motion of the MEMS device 102.

Figure 3C:
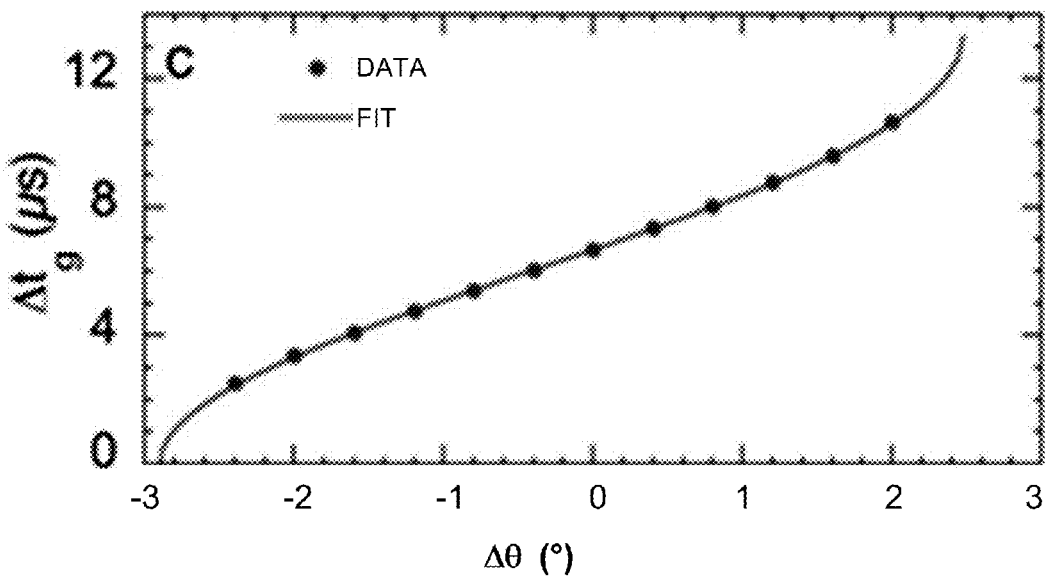

In FIG. 3C, illustrated data generally designated by the reference character 330 shows measured values dots and calculation with the measured time gap between the X-ray pulses fits perfectly with the following Eq. (2) set forth below when the maximum value of the MEMS deflection is ±2.69°.

Figure 3D:
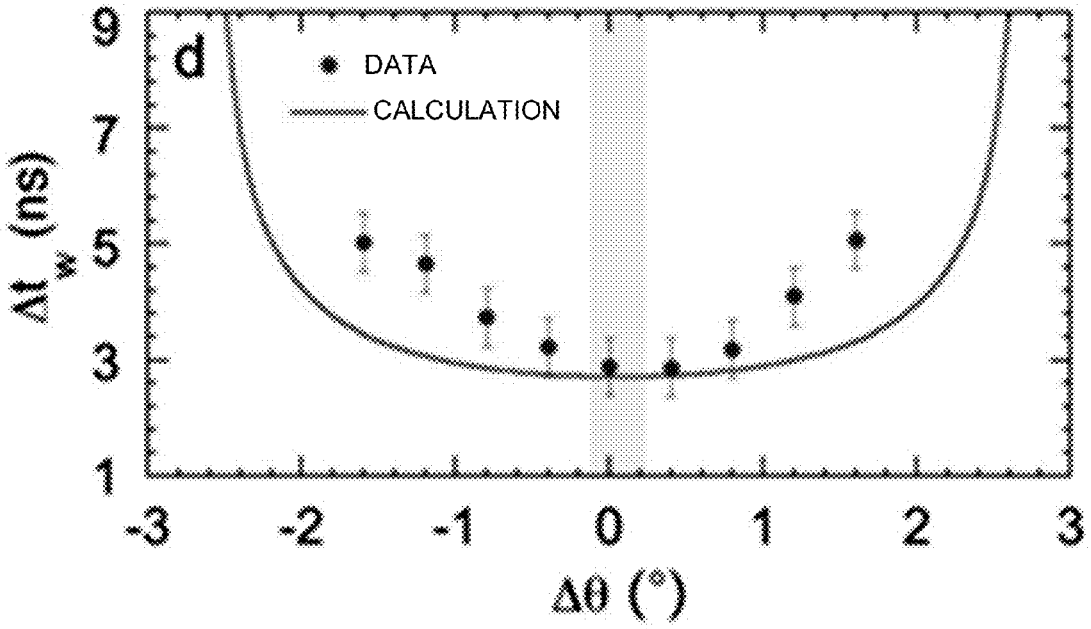

In FIG. 3D, illustrated data generally designated by the reference character 340 shows measured values dots and calculation with a width, $\Delta t_w$, of Si(400) diffraction peak obtained from the time-domain diffraction profiles analyzed using the 3-Gaussian model shown as a function of Δθ. The measured values dots deviate from the following Eq. (3) set forth below represented by a solid line curve indicating increased dynamic distortion of the MEMS when deviating further from Δθ=0.

Operation of the apparatus 100 and MEMS based diffractive optics device 200 of the invention may be understood as follows. When the crystal is strain and defect free, the value of $\Delta\theta_{(400)}$ is determined by a convolution between the angular and energy widths of the incoming monochromatic beam and the Darwin width of the Si(400) crystal which was calculated to be 0.0028° (49 microradians). The measured $\Delta\theta_{(400)}$ is about 20% broader, which can be accounted from the static deformation strain of the suspended 25-μm thick MEMS crystal. The static deformation of 0.0014° (24 microradians) was estimated from the measured concave curvature of the crystal from both optical and X-ray data. This broadens the rocking curve width to 0.0032° (55 microradians) in good agreement with the measured value. This detailed analysis of the static rocking curve ascertained that the MEMS is well suited as an X-ray diffractive optics.

When the MEMS is so aligned that the X-ray incident angle is $\theta_0$ when crystal element is stationary, the time dependence of the incident angle θ during the oscillation can be described as $\theta(t)=\theta_0+\alpha_m \cos(2\pi f_m t)$. The angular velocity of MEMS, ω(t), is given by:

$$\omega(t)=\omega_{max}\sin(2\pi f_m t) \tag{1}$$

where $\omega_{max}=2\pi f_m \alpha_m$ is the maximum angular velocity of by the MEMS. The incident X-ray beam is diffracted at the Bragg condition, $\theta(t)=\theta_B$, and that occurs twice in an oscillation cycle. The value of $|\omega(t)/\omega_{max}|$ is unity at T/4 and 3T/4 as shown in FIG. 3A, where $T=1/f_m$ is the oscillation period.

For a crystal with a rocking curve width $\Delta\theta_{(hkd)}$ (for diffraction plane hkl), the gap between two consecutive diffraction-windows (in an oscillation cycle), $\Delta t_g$, and the width of the diffraction-time-window, $\Delta t_w$, are dependent on the angular offset defined by $\Delta\theta=\theta_B-\theta_O$ and given by, $$\Delta t_g=(1/f_m)-(\cos^{-1}(\Delta\theta/\alpha_m)/(\pi/f_m)) \tag{2}$$

And, where $$\Delta t_w=(\Delta\theta_{(hkd)})/(2\pi f_m \alpha_m\cdot((1-(\Delta\theta/\alpha_m)^2)^{1/2}) \tag{3}$$

From these equations it can be noted that the smallest width of the diffraction-time-window, $(\Delta\theta_{(hkd)})/(2\pi f_m \alpha_m)$, is obtained when $\Delta\theta=0(\theta_O=\theta_B)$ corresponding to a gap between pulses of $1/(2f_m)$.

The dynamic performance of the MEMS is evaluated from X-ray intensity measurements in the time domain by subjecting it to the incident X-ray pulse-train during the APS standard operating mode in which the pulse-to-pulse separation is 153.4 ns. The MEMS is driven by a 70 $V_{pp}$ actuation signal with frequency $2f_m$($f_m$=74.671 kHz), resulting in a harmonic oscillation with a nominal amplitude $\alpha_m$=±3° and period (T) of 13.392 μs. During each MEMS oscillation cycle, only the X-ray pulses that satisfy the Bragg condition over a defined Si(400) diffractive time window will be diffracted.

In an experiment, the time dependence of the 8 keV diffracted X-ray intensities were collected for different values of Δθ by a fast-response avalanche photodiode detector (APD) operating in a charge-integrating mode, as further described below in an example method of operation. The profile of the diffractive time window is constructed by varying the arrival time of the X-ray pulses with respect to the MEMS driving signal. The measured diffractive window in the time domain is shown in FIG. 3B as a function of Δθ. Since $\Delta t_w$ is only several nanoseconds, the intensity traces in FIG. 3B are plotted in an expanded time scale by a factor of 20 to make their shapes clearly visible.

The traces shown in FIG. 3B emphasize symmetrical performance of the MEMS in an oscillation cycle. Along the vertical axis, the intensity peaks are offset by the amount of Δθ, ranging from −2.4° to +2.0°, within the nominal oscillation amplitude of the MEMS. The intensity peaks are clearly in two branches, corresponding to the two instances in time when Bragg condition was met within an oscillatory cycle from two rotation directions. Their position on the plot is denoted by the solid dots in FIG. 3B. The two critical dynamic parameters, $\Delta t_g$ and $\Delta t_w$, can be derived from the diffraction peaks, as is illustrated in FIG. 3B. The values of $\Delta t_g$ are plotted in FIG. 3C as a function of Δθ, along with a fit (solid line) using Eq. (2). The remarkable agreement between the data and the fit allowed accurate and independent determination of the MEMS oscillation amplitude, $\alpha_m$=±(2.692. ±0.01)°, the only fitting parameter in the equation. As reflected in Eqs. (1)-(3), this is the most critical parameter necessary to describe all the dynamic properties of the MEMS.

The diffraction profiles shown in FIG. 3B as a function Δθ (and the mirror images) retain the features measured in the static rocking curve FIG. 2B). However the width of the Si(400) peak (or $\Delta t_w$) varies with Δθ and in fact, it is inversely proportional to the angular velocity of the MEMS, as expected from Eq. (3). Of all the peaks in the profiles, the narrowest and highest intensity peaks occurs when Δθ equals 0 (Δθ=0) at which the MEMS reaches the maximum angular velocity $\omega_{max}$=1.262°/μs.

It is important to notice that this angular velocity is nearly an order of magnitude higher than that of a flywheel, and is achieved with an order of magnitude lower linear velocity.

The peak narrows when the angular velocity increases (FIGS. 3A, 3B and FIGS. 1C, 1D) and its intensity increases as $|\Delta\theta|$ decreases (FIG. 3B). Therefore, the time-domain diffraction profiles can be analyzed with confidence using the 3-Gaussian model (used to fit the static rocking curve in FIG. 2B) to extract the width $\Delta t_w$ of the most prominent Si(400) diffraction peak. The values of $\Delta t_w$ are shown as a function of $\Delta\theta$ in FIG. 3D, along with calculated values (solid line) using Eq. (3) with no adjustable parameters. Within experimental error, the data are adequately accounted for at $\Delta\theta=0$ by Eq. (3), without introducing additional strain-related broadening of the rocking curve, demonstrating negligible dynamic distortion of the MEMS at this X-ray incident angle. Away from this condition, measured $\Delta t_w$ departs rapidly from that predicted by Eq. (3), suggesting that the broadening of $\Delta\theta_{(400)}$ stems from growing amount of strain introduced by dynamic deformation.

Figure 4:
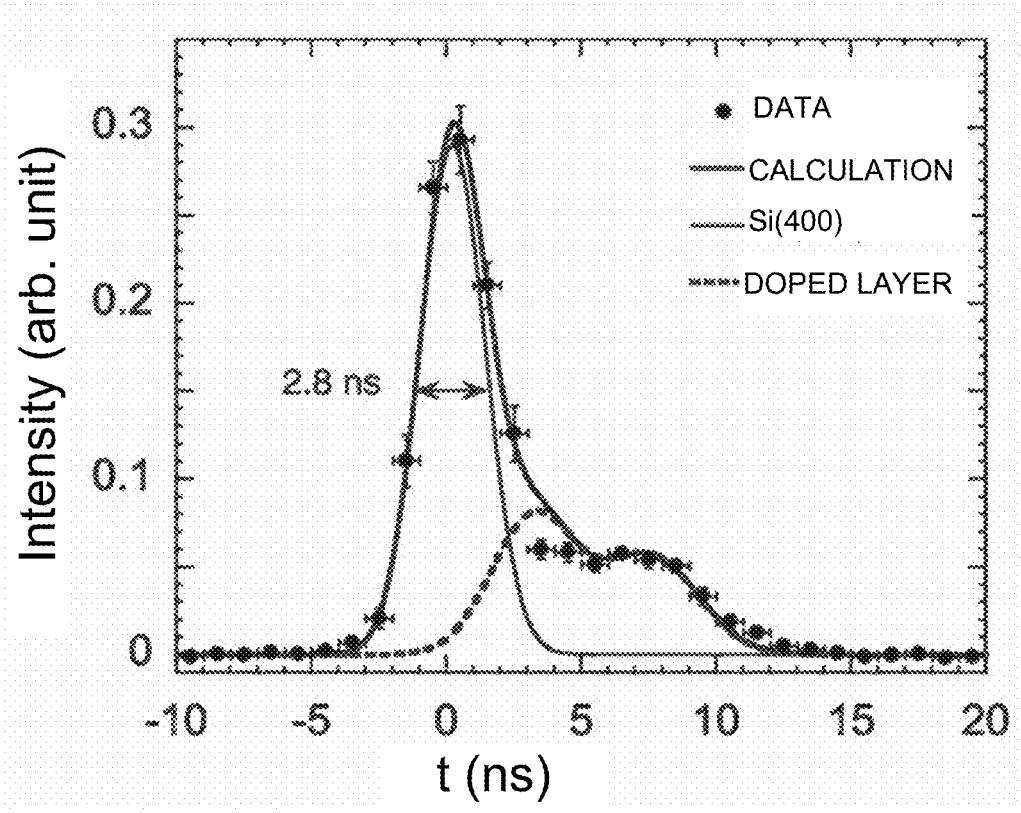
FIG. 4 illustrates an example X-ray diffractive time window achieved with a MEMS based diffractive optics with time in nanoseconds (ns) shown relative the horizontal axis and intensity (arbitrary units) shown relative the vertical axis in accordance with preferred embodiments.

To highlight the narrowest diffractive window achieved with the MEMS optics, the measured dynamic diffraction profile at $\Delta\theta=0$ is shown in detail in FIG. 4, along with a 3-Gaussian fit. The resulting $\Delta t_w$ corresponding to the prominent Si(400) peak is 2.8±0.4 ns. This is in excellent agreement with the value of 2.7 ns obtained from Eq. (3) using experimentally obtained value of $\Delta\theta_{(400)}=0.0034°$, $\alpha_m=\pm2.69°$, and $f_m=74.671$ kHz.

Referring also to FIG. 4, there is shown an example X-ray diffractive time window generally designated by the reference character 400 achieved with the MEMS based diffractive optics 102, 200. In FIG. 4, time in nanoseconds (ns) is shown relative the horizontal axis and intensity (arbitrary units) shown relative the vertical axis in accordance with preferred embodiments. The measured dynamic diffraction profile (dots) at $\Delta\theta=0$ is fitted with a 3-Gaussians (lines). The dashed line curve reflects the peaks associated with a dopant layer identical to those observed in the static diffraction profile. The resulting $\Delta t_w$ for the prominent Si(400) peak is 2.8±0.4 ns in agreement with the that obtained from Eq. (3) using experimentally obtained values of $\Delta\theta_{(400)}=0.0034°$, $\alpha_m=\pm2.69°$, and $f_m=74.671$ kHz.

In accordance with features of the invention, it is hence concluded with full confidence that MEMS devices can be successfully used as an X-ray diffractive optics. This is the first demonstration of the potential of MEMS diffraction technology in the X-ray wavelength range to control the pulse train from a synchrotron radiation source. This opens many new avenues for the use of MEMS to manipulate and control X-ray radiation. For example, at any hard X-ray storage-ring or XFEL source 104, the present MEMS 102 can be used to select an X-ray pulse or a stream of pulses from a pulse-train with a pulse separation of over 2.8 ns. This accounts for most of the third-generation sources currently operational worldwide. The X-ray fluence from this optics 102 will be enhanced from the ultra-small beam dimensions obtainable from the new generation of storage-ring sources with sub-nm-rad emittance. There are four control parameters for MEMS operation, namely $\theta_B$, $\Delta\theta_{(hld)}$, $\alpha_m$, and $f_m$, that add many new capabilities to control the X-ray energy, pulse selection, and the shape of the pulse. For example, MEMS optics can be used for time-domain science experiments requiring a broad range of X-ray energy from about 4 to 50 keV by choosing appropriate $\theta_B$. This will commensurately broaden or narrow the diffractive time-window through the values of $\Delta\theta_{(hld)}$. The values of angular amplitude $\alpha_m$ can also be varied by orders of magnitude either by varying the voltage of MEMS excitation pulse or by varying the ambient pressure in which the device operates. This would allow selection of X-ray pulses from MHz-GHz sources. Furthermore, MEMS operation with large values of $\alpha_m$ and $f_m$ will allow even narrower time windows than reported here, and one can even reach the ultimate potential to slice 100 ps duration X-ray pulses by one to two orders of magnitude (similar to laser slicing of electron bunches) at a storage-ring source, a unique capability for a broad research community. In summary, the reported performance of ultrafast MEMS with flexible control over the delivery and the shape of hard X-ray pulses will herald new opportunities in time-resolved X-ray studies at any synchrotron radiation source.

Example Implemented Method

In accordance with features of the invention, methods implemented with the MEMS based diffractive optics 102, 200 may be understood as follows:

The torsional MEMS device 102, 200 includes a single-crystal-silicon mass 202 with a smooth surface suspended on opposite sides by a pair of torsional springs 204, 206. The crystal 202 can be rotated in an oscillatory motion about the torsional springs 204, 206 by applying an electrical field to the comb-drive actuators 210. Finite Element Analysis (FEA) was conducted to determine the modal response of the MEMS device 102, 200. Using CoventorWare® simulations show the first harmonic resonance occurring at 74.6 kHz which was verified from experimental measurements to be ≈74.7 kHz. The MEMS device 102, 200 were fabricated at the commercial foundry MEMSCAP using SOIMUMPS® fabrication process with a 25 μm thick device layer. The measured oscillation amplitude of about ±3° required an application of 70 $V_{pp}$.

The x-ray experiments were performed at Sector 7-ID beamline, a dedicated beamline for ultrafast x-ray experiments of the Advanced Photon Source (APS) at Argonne National Laboratory. The X-ray beam, produced by an undulator source, was monochromatized by a flat diamond double-crystal monochromator tuned to photon energy of 8 keV with a bandwidth of $5\times10^{-5}$. The X-ray beam was not focused and was defined by a pair of X-Y slits to a size of 100 μm (horizontal)×6 μm (vertical) before impinging on the MEMS device. The static rocking curves around the Si(400) Bragg angle was measured by using a high-resolution diffractometer with a minimum angular step size of $3.125°\times10^{-5}$. The diffracted photons were detected by an avalanche photodiode (APD) operated in photon-counting mode. For dynamic measurement, the transient X-ray diffraction signal when Bragg condition was met was measured by another APD but operated in charge-integration mode. The integration mode is needed because every diffracted X-ray pulse contained multiple photons. The APD has a fast response with temporal resolution of approximately 5 ns. The APD signal output was digitized by a 500-MHz oscilloscope and recorded every 1 ns, which determines the temporal resolution in determining the delay time between the MEMS driver pulse and the X-ray pulse diffracted by the MEMS crystal element. The oscilloscope trace of 1 ms was measured 20 times to improve the signal-to-noise ratio.

While the present invention has been described with reference to the details of the embodiments of the invention shown in the drawing, these details are not intended to limit the scope of the invention as claimed in the appended claims.

What is claimed is:

1. A method for implementing Bragg-diffraction leveraged modulation of X-ray pulses using MicroElectroMechanical systems (MEMS) based diffractive optics comprising:

providing an oscillating crystalline MEMS device;

providing an incident pulse train of X-ray synchrotron radiation on the oscillating crystalline MEMS device; and selecting pulses with Bragg-diffraction leveraged modulation of the incident pulse train of X-ray synchrotron radiation and generating a controllable time-window of the selected pulses-using the oscillating crystalline MEMS device and diffracting X-ray pulses during an oscillation cycle of the oscillating crystalline MEMS device when the incident pulse train of X-ray synchrotron radiation has an angle of incidence equal to a Bragg angle $\theta_B$ for the oscillating crystalline MEMS device; a width of the controllable time-window determined by an angular velocity of the oscillating crystalline MEMS device; and providing an angle of incidence equal to said Bragg angle $\theta_B$ for the oscillating crystalline MEMS device for isolating the selected pulses, and angularly separating each of the selected pulses.

2. The method as recited in claim 1, wherein providing incident X-ray radiation on the oscillating crystalline MEMS device includes providing X-ray pulses from a synchrotron radiation source.

3. The method as recited in claim 1 wherein providing an oscillating crystalline MEMS device includes providing a controllably oscillated crystalline MEMS device by providing a selected oscillation frequency.

4. The method as recited in claim 3 includes changing said controllable time-window of selected pulses by providing said selected oscillation frequency.

5. The method as recited in claim 3 wherein providing said selected oscillation frequency includes providing a pair of comb-drive actuators together with respective torsional flexures for driving an X-ray diffractive crystal.

6. The method as recited in claim 1 includes providing a selected oscillation frequency for the oscillating crystalline MEMS device for isolating the selected pulses, and angularly separating the selected pulses.

7. The method as recited in claim 1 includes providing an angle of incidence equal to a Bragg angle $\theta_B$ for the oscillating crystalline MEMS device and providing a selected oscillation frequency for the oscillating crystalline MEMS device for separating a pulse from an X-ray pulse-train and diffracting X-ray pulses during said oscillation cycle of the oscillating crystalline MEMS device when the incident X-ray radiation has said angle of incidence equal to said Bragg angle $\theta_B$ for the oscillating crystalline MEMS device.

8. The method as recited in claim 1 wherein providing said oscillating crystalline MEMS device includes fabricating said oscillating crystalline MEMS device using a Silicon-On-Insulator (SOI) wafer for providing a single-crystal-silicon, and removing a substrate beneath the single-crystal-silicon.

9. The method as recited in claim 8 wherein fabricating said oscillating crystalline MEMS device includes providing a pair of torsional flexures coupled to single-crystal-silicon and anchored to the substrate.

10. The method as recited in claim 9 includes providing a respective pair of comb-drive actuators coupled to the pair of torsional flexures.

11. The method as recited in claim 10 includes providing said comb-drive actuators with inter-digitated capacitors (IDCs).

12. An apparatus for implementing Bragg-diffraction leveraged modulation of X-ray pulses using MicroElectro-Mechanical systems (MEMS) based diffractive optics comprising:

an oscillating crystalline MEMS device;

an X-ray source providing an incident pulse train of X-ray synchrotron radiation on the oscillating crystalline MEMS device; and said oscillating crystalline MEMS device selecting pulses with Bragg-diffraction leveraged modulation of the incident pulse train of X-ray synchrotron radiation and generating a controllable time-window of the selected pulses-and diffracting X-ray pulses during an oscillation cycle of the oscillating crystalline MEMS device when the incident pulse train of X-ray synchrotron radiation has an angle of incidence equal to a Bragg angle $\theta_B$ for the oscillating crystalline MEMS device; a width of the controllable time-window determined by an angular velocity of the oscillating crystalline MEMS device; and said oscillating crystalline MEMS device provides Bragg-diffraction leveraged modulation of X-ray pulses including isolating a pulse, and angularly separating individual pulses from an X-ray pulse-train and diffracting X-ray pulses during the oscillation cycle of the oscillating crystalline MEMS device when the incident X-ray radiation has said angle of incidence equal to said Bragg angle $\theta_B$ for the oscillating crystalline MEMS device.

13. The apparatus as recited in claim 12 wherein said oscillating crystalline MEMS device includes a Silicon-On-Insulator (SOI) wafer including a single-crystal-silicon forming an X-ray diffractive crystal, a substrate being removed below the single-crystal-silicon.

14. The apparatus as recited in claim 13 wherein said oscillating crystalline MEMS device includes a respective pair of torsional flexures coupled to said single-crystal-silicon and said substrate.

15. The apparatus as recited in claim 14 wherein said oscillating crystalline MEMS device includes a respective pair of comb-drive actuators coupled to the pair of torsional flexures, said comb-drive actuators including inter-digitated capacitors (IDCs).

16. The apparatus as recited in claim 12 wherein said X-ray source includes a synchrotron radiation source providing X-ray pulses to said oscillating crystalline MEMS device.

* * * * *